US005441025A

United States Patent [19]

Ryberg

[11] Patent Number: 5,441,025

[45] Date of Patent: Aug. 15, 1995

[54] DEVICE FOR STARTING AND STOPPING A DIESEL ENGINE

[75] Inventor: Bertil Ryberg, Torslanda, Sweden

[73] Assignee: AB Volvo Penta, Gothenburg, Sweden

[21] Appl. No.: 157,102

[22] PCT Filed: Jun. 3, 1992

[86] PCT No.: PCT/SE92/00377

§ 371 Date: Feb. 3, 1994

§ 102(e) Date: Feb. 3, 1994

[87] PCT Pub. No.: WO92/21873

PCT Pub. Date: Dec. 10, 1992

[30] Foreign Application Priority Data

Jun. 3, 1991 [SE] Sweden ..... 9101681

[51] Int. Cl.[6] ..... F02B 77/00

[52] U.S. Cl. ..... 123/198 DB

[58] Field of Search ..... 123/193 DB, 359, 357, 123/373

[56] References Cited

U.S. PATENT DOCUMENTS

| | | | |
|---|---|---|---|
| 4,388,900 | 6/1983 | Hoshi | 123/198 DB |
| 4,424,782 | 1/1984 | Emmerich | 123/198 DB |
| 4,594,980 | 6/1986 | Detweiler | 123/198 DB |
| 4,757,791 | 7/1988 | Hachitani et al. | 123/357 |
| 4,922,873 | 5/1990 | Gaeti | 123/198 DB |
| 4,924,827 | 5/1990 | Minegishi | 123/198 DB |
| 5,131,361 | 7/1992 | Hartman et al. | 123/373 |

FOREIGN PATENT DOCUMENTS 368978 7/1974 Sweden .

*Primary Examiner*—Noah Kamen

*Attorney, Agent, or Firm*—Young & Thompson

[57] ABSTRACT

An electromagnetic device for starting and stopping diesel engines. The device comprises a spring biased pulling-rod (12) which is joined to the armature of the electromagnet (11), a lever biased by a spring (6) has a cam roller (7) which presses against the rod. The lever is fixed on a shaft which controls a starting/stopping device in the engine fuel pump.

3 Claims, 1 Drawing Sheet

DEVICE FOR STARTING AND STOPPING A DIESEL ENGINE

FIELD OF THE INVENTION

The present invention relates to an electromagnetic device for starting and stopping a diesel engine, comprising a solenoid with means for mounting the same relative to the engine injection pump housing and an armature cooperating with a starting/stopping means having a lever element carried on a shaft rotatably mounted in said housing.

BACKGROUND OF THE INVENTION

A electromagnetic device of this type is used in diesel engines to either cut off or start the supply of fuel from the engine injection pump in order to kill or start the engine. In one case the supply of fuel is open when the circuit is completed thereby activating the solenoid and in the second case the supply of fuel is cut off when the circuit is completed. Different applications will in this case require different design arrangements.

A known device for starting and stopping uses a pulling solenoid with an armature, which via a ball joint and an extendible linkage arm acts on a lever which is fixed to a shaft rotatable in the fuel pump housing, and this will affect the fuel supply regulating element in the regulator. The linkage arm is joined to the lever via a pivot pin extending into an opening in the lever. The solenoid has two coils, one for pulling and one for holding. Devices of this type are susceptible to reliability problems due to sluggishness in the mechanical linkage system in combination with weak magnets and this can result in burned windings.

SUMMARY OF THE INVENTION

The purpose of the present invention is to provide an electromagnetic starting and stopping device of the type described by way of introduction, which is small and compact, has high reliability and can be mounted directly on a fuel pump housing.

This is achieved according to the invention by virtue of the fact that the lever element has a cam surface and is spring biased to press the cam surface against a surface on the armature or an element joined to the armature and that the solenoid is disposed when actuated to provide a force acting between the armature and the lever element to pivot the lever element.

The arrangement with interacting cam elements which are pressed into contact by the springs, eliminates the need for linkages, the links of which must be carefully adapted to the installation in question. The present invention does not require precision in installation and makes possible low resistance to operating movement.

In a preferred embodiment of the invention the armature exerts a pulling force when actuated and is spring biased towards the lever element with the spring force which is greater than the force with which the spring force biasing the lever element loads the armature in the opposite direction. For example, the spring force on the armature acting opposite to its actuation direction can be about twice the force provided via the spring biased lever in the opposite direction, and this means that the magnet must in principle be dimensioned to provide slightly more than half of the spring force acting against the lever element.

BRIEF DESCRIPTION OF THE DRAWINGS

The invention will be described in more detail below with reference to an example shown in the accompanying drawings, where.

DETAILED DESCRIPTION OF THE INVENTION

Figure 1:
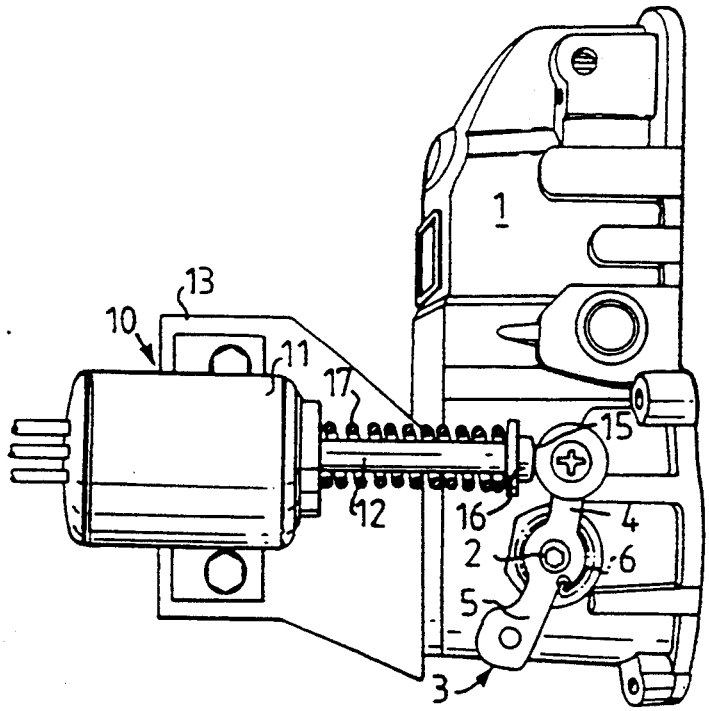
FIG. 1 shows a perspective view of a portion of a fuel pump housing with a start/stop device in a first mounting configuration and FIG. 2 shows a view corresponding to FIG. 1 with the start/-stop device in an alternative mounting configuration.
Figure 2:
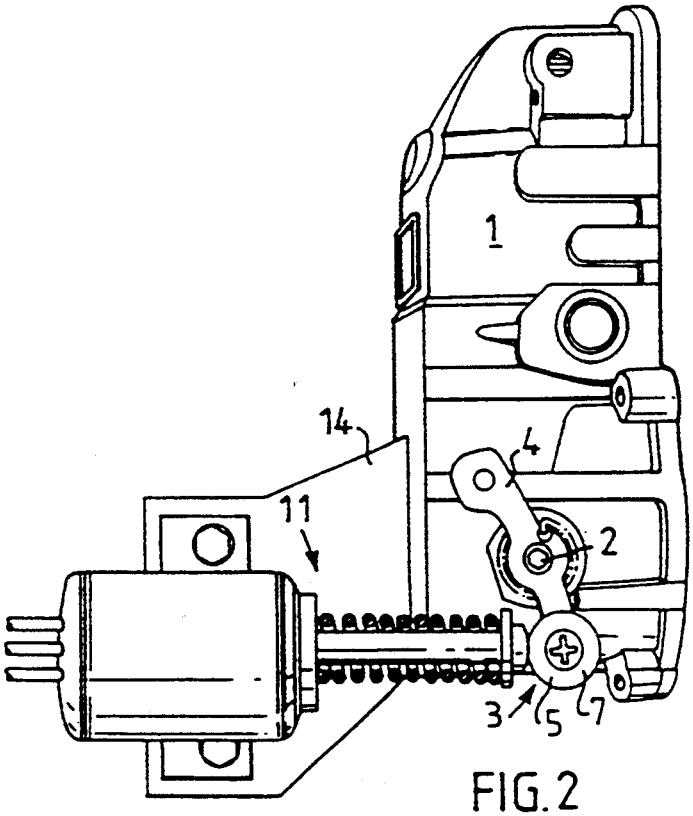

In the Figures, 1 designates a portion of the injection pump housing of a diesel engine. The injection pump is of a type known per se and since the design is not crucial to the present invention it will not be described in more detail here. Suffice to say the injection pump has a shaft 2 pivotably mounted in the housing and the shaft acts on means (not shown) arranged in the housing which increase or decrease the flow of fuel from the pump to the engine cylinders depending on the setting of the shaft 2. A double lever 3 is fixed to the shaft and has two arms 4 and 5 arranged symmetrically above the shaft 2. The lever 3 in FIG. 1 is spring biased counterclockwise by a schematically indicated spring 6. In FIG. 1 a cam roller 7 is rotatably mounted on the upper arm 4. In FIG. 2, the cam roller 7 has moved to the lower arm 5, and the lever 3 is spring biased clockwise.

An electromagnetic starting and stopping device, with the general designation 10, comprising an electromagnet 11, an armature (not shown) and an operating rod solidly joined to the armature, is securely bolted to a bracket 13 (FIG. 1) or 14 (FIG. 2), which is in turn securely bolted to the housing 1. The bracket 13 is designed so that the end surface 15 of a nut element 16 screwed unto the end of the rod 12 faces the cam roller 7 in its upper position shown in FIG. 1, and the bracket 14 is designed so that the nut element 16 will face the cam roller 7 in its lower position shown in FIG. 2.

When current is supplied to the electromagnet, the operating rod 12 will be displaced to the left in the Figures. The force acting to the left from the electromagnet will be opposed by a force from a spring 17. The spring 17 is selected so that the force which it provides pressing the rod 12 against the cam roller 7 is approximately twice the force provided by the spring 6 pressing the cam roller 7 in the opposite direction. The electromagnet must therefore be designed to overcome approximately half of the force from the spring 17.

In the embodiments shown in FIGS. 1 and 2, the operating rod 12 pivots the lever 3 counter clockwise or clockwise when current is supplied to the electromagnet. In one case the supply of fuel is stopped to the engine when current is turned on. In the other case, the supply of fuel is cut off until the current is turned on thus starting the supply of fuel. In marine applications for example the former embodiment can be suitably used to stop the engine when current is supplied and the latter embodiment can be used in industrial engines which should be stopped when there is a power failure.

The invention provides a simple and reliable device for starting and stopping a diesel engine, which can be easily modified from one embodiment to the other. To change from the embodiment in FIG. 1 to the embodiment of FIG. 2, the bracket 13 is replaced with a bracket 14, the spring 6 is changed so that it biases lever 3 clockwise and the cam roller 7 is moved from the upper arm 4 to the lower arm 5. No linkages need to be moved or adjusted as regards length and angles. Within the scope of the invention it is also possible as an alternative to the embodiments shown and described in which the solenoid 11 is fixed directly to the pump 1, to mount the solenoid somewhere else near the pump, e.g. on an engine room wall close to the pump, and to achieve pivoting of the lever 3 via a linkage system, not shown in more detail here, which comprises an operating rod corresponding to the rod 12.

I claim:

1. In a device for starting and stopping a diesel engine having an injection pump housing which comprises a solenoid with means for mounting the solenoid relative to the engine injection pump housing and an armature cooperating with a starting/stopping means having a lever element carried on a shaft rotatably mounted in said housing, the improvement wherein the lever element (3) has a cam surface (7) and is spring biased to press the cam surface against a surface (15) on the armature or an element (12,16) joined to the armature, said solenoid (11) being disposed when actuated to provide a force acting between the armature and the lever element to pivot the lever element, said armature being spring biased towards the lever element (3) with a spring force which is greater than the force with which the spring force biasing the lever element loads the armature in the opposite direction, and said armature being disposed upon actuation of the solenoid to provide a pulling force which is greater than the difference between said spring forces.

2. Device according to claim 1, wherein the lever element (3) is two-sided with means (4,5) for arranging the cam surface (7) on one side and/or an opposite side of said shaft (2), upon application of a force between the armature and the cam surface on said one side and the lever element being pivoted in the first direction and upon application of the force between the armature and the cam surface on the said opposite side the cam element being pivoted in opposite direction.

3. Device according to claim 1, wherein said cam surface is formed by the peripheral surface of a cam roller (7) carried by the lever element (3).

* * * * *